United States Patent [19]

Gustaveson et al.

[11] Patent Number: 4,843,782

[45] Date of Patent: Jul. 4, 1989

[54] BEHIND-THE-CEILING MOUNTING FOR TELEVISION RECEIVER

[76] Inventors: Keith I. Gustaveson; Elsie E. Gustaveson, both of 3193 Deer Creek Cir., Salt Lake City, Utah 84121

[21] Appl. No.: 269,360

[22] Filed: Nov. 10, 1988

Related U.S. Application Data

[63] Continuation-in-part of Ser. No. 112,995, Oct. 26, 1987.

[51] Int. Cl.[4] ..... E04B 5/52; A47B 81/06

[52] U.S. Cl. ..... 52/39; 312/7.2; 312/242; 52/64; 52/173 R

[58] Field of Search ..... 52/39, 64, 173 R, 27; 312/7.2, 242; 248/185, 317

[56] References Cited

U.S. PATENT DOCUMENTS

| | | | |
|---|---|---|---|
| 3,100,915 | 8/1963 | Penwington | 52/64 |
| 4,395,785 | 8/1983 | Phil-Yoo-Huh | 52/432 |
| 4,412,601 | 11/1983 | Cooper | 312/247 |
| 4,594,817 | 6/1986 | McLaren | 52/36 |
| 4,625,470 | 12/1986 | Heritage | 52/39 |

*Primary Examiner*—John E. Murtagh
*Attorney, Agent, or Firm*—Philip A. Mallinckrodt; Robert R. Mallinckrodt

[57] ABSTRACT

Provision for mounting a television receiving set behind the ceiling of a room, such as a bedroom, for viewing by a person reclining or sitting with head back, is made by a support portion of a protective housing positioned or adapted to be positioned behind a viewing opening in the ceiling of the room and sloping upwardly from such opening. The viewing opening is normally closed by a ceiling panel hinged as a door along its forward end, but can be opened for viewing of or projection by the television receiver by remote-controlled mechanism operative to raise and lower the panel door on its hinging axis, which is preferably free. The mechanism is arranged to pull a flexible draw line for raising the panel door and to slacken such line so the panel can return to closed position by the force of gravity. So as to seat properly in closed position, the panel door is a sheet of pliable material having sufficient rigidity to be shape retaining, preferably a one-quarter inch thick, medium density fibreboard, it and the viewing opening and door-seating structure that is peripheral marginally of the panel door preferably being of rectangular configuration and the upper surface of the ceiling panel door being reinforced peripherally inwardly of the seating margins and, depending upon shape and size of the panel door, also longitudinally intermediate the width of such door by mutually independent lengths of rigid material, such as structural steel angles which do not intersect. For easy removal through the viewing opening when the mechanism is mounted on top of the housing and the panel door removed, such housing is provided with an opening at least commensurate in size with the mechanism and the mechanism is mounted on a base plate that is removably secured across the opening.

16 Claims, 2 Drawing Sheets

BEHIND-THE-CEILING MOUNTING FOR TELEVISION RECEIVER

PRIOR APPLICATION

The present application is a continuation-in-part of our copending, allowed application Ser. No. 112,995, filed Oct. 26, 1987, and covers significant improvements in the invention disclosed therein.

BACKGROUND OF THE INVENTION

1. Field

The invention is in the field of structure for mounting a television receiving set.

2. State of the Art

It has long been customary to mount television receiving sets immediately below the ceilings of rooms, such as in a hospital, for viewing by a person lying in bed. Various mounting brackets attached to room walls or ceilings have been employed for the purpose.

3. Objects of this Invention

Principal objects in the making of the invention of my aforesaid patent were to provide behind-the-ceiling mounting structure for a television receiving set which would support and house such a set in proper position for viewing by someone lying in bed or reclining on a couch, sofa, or other support, or even sitting back in a chair, which would be hidden during non-use, and which would be equipped with simple and effective mechanism for opening and closing a ceiling panel by remote control of a person desiring to view a television program.

An object in the making of the present improvements on that invention was to provide a ceiling panel door construction for such a device that would ensure proper seating relative to panel framing such that, when in closed position, there would be no visual break indicative of its door function and tending to disrupt the normal continuity of the ceiling.

A further object was to provide for easy access through the interior of the mounting structure for repairs or replacement of the door lifting mechanism.

BRIEF SUMMARY OF THE INVENTION

In accordance with the invention of the aforesaid patent, the television receiving set is mounted on an upwardly and backwardly sloping support immediately behind a viewing opening in the ceiling, and such viewing opening is normally closed and rendered unobvious by a ceiling panel door that harmonizes with the ceiling decor, plain or decorative as it may be. Such ceiling panel hinges along its forward end, and remote controlled mechanism is provided, preferably above the viewing space and over the viewing opening, with connection to the ceiling panel by a flexible line for raising and lowering such ceiling panel on its hinge axis as a door. Mounting structure in the form of a box-type housing rises from and slopes upwardly and backwardly from a relatively broad bottom opening. Such mounting structure provides an upwardly and backwardly sloping bottom wall upon which the television receiving set is securely mounted and an upwardly and backwardly sloping top wall, which, together with side walls, protectively enclose the television receiving set.

The mechanism for opening and closing the panel door comprises a reversible electric motor constructed to be turned on by remote control, together with limit switches for turning it off. A flexible line, having one end attached to the hinged ceiling panel, for raising and lowering it on its hinge axis, has its other end attached to a part of the mechanism operated by the motor. In one embodiment of the mechanism, such part is a traveler arranged to reciprocate rectilinearly. The traveler is preferably secured to one length of a chain looped about drive and idler sprockets at opposite ends, respectively, of the path of travel of the traveler, the drive sprocket being located at and in driven connection with the motor. In another embodiment, such part is a pulley in driven connection with the motor for winding and unwinding the flexible line in windless fashion.

The present improvements constitute structural changes made to solve problems encountered with the construction shown in our aforesaid patent under some circumstances and to provide easy access to the operating mechanism without the necessity of entering the attic space in which the device of the invention is located.

It has been found that the ceiling panel door mounted for opening and closing poses a problem if made of plywood, as it has been in actual practice. Plywood and other types of wood have a tendency to warp somewhat in a relatively short time after installation as the ceiling panel door in the device of the invention. This is true even if three-quarter inch plywood is used for the panel rather than thinner and cheaper plywood.

It is important that the ceiling panel door seat uniformly on and against the panel door framing about substantially the entire perimeter of such framing marginally of the viewing opening so as not to disrupt normal continuity of the ceiling. For this purpose and in accordance with the present improvements, it has been found that the panel should be of sheet pliable material having sufficient rigidity to substantially retain its shape during raising and lowering thereof as a door. Preferably, the pliable material is a medium density fibreboard, such as "Masonite", one-quarter of an inch in thickness and reinforced marginally and peripherally on and about its upper face inwardly of the seating margins of the panel. Depending upon the shape and size of the panel, it is also reinforced from front to back intermediate its width. The reinforcing members should be independent of one another and preferaly do not intersect. Constructed in this manner, it has been found unnecessary to secure the hinging forward end of the panel to the panel framing. Hinging is effectively achieved by freely resting the forward end of the panel on its corresponding portion of the panel framing structure. In this way, it is possible to remove the panel door and to arrange the opening and closing mechanism above an access opening through the top wall of the housing so such mechanism can be removed through the interior of the housing for repair or replacement.

THE DRAWINGS

The best mode presently contemplated for carrying out the improvements to the invention are illustrated in the accompanying drawings in which:

FIG. 1 is a view in perspective of a portion of the ceiling of a room in which the apparatus of the invention is installed, with the ceiling panel door raised into open position for television viewing from a reclining position in the room;

FIG. 2, a corresponding view, with the ceiling panel door lowered into closed position;

FIG. 3, a fragmentary perspective view of the television receiver mounting structure of FIG. 1 looking down from above the ceiling of the room in the attic, the view being drawn to a considerably larger scale than the preceeding figures and with an intermediate portion of the top wall of the structure and a portion of the ceiling panel door broken away to reveal otherwise hidden structure;

FIG. 4, a longitudinal vertical section taken axially through the structure of FIG. 3 and showing in side elevation one embodiment of mechanism for opening and closing the ceiling panel door and, in section, the mounting of and the access opening for such mechanism, the view being drawn to an even larger scale than in FIG. 3;

FIG. 5, a transverse section taken on the line 5—5 of FIG. 4 and again drawn to a larger scale than previously; and FIG. 6. a top plan view of the ceiling panel door per se.

DETAILED DESCRIPTION OF THE ILLUSTRATED EMBODIMENT

Figure 1:
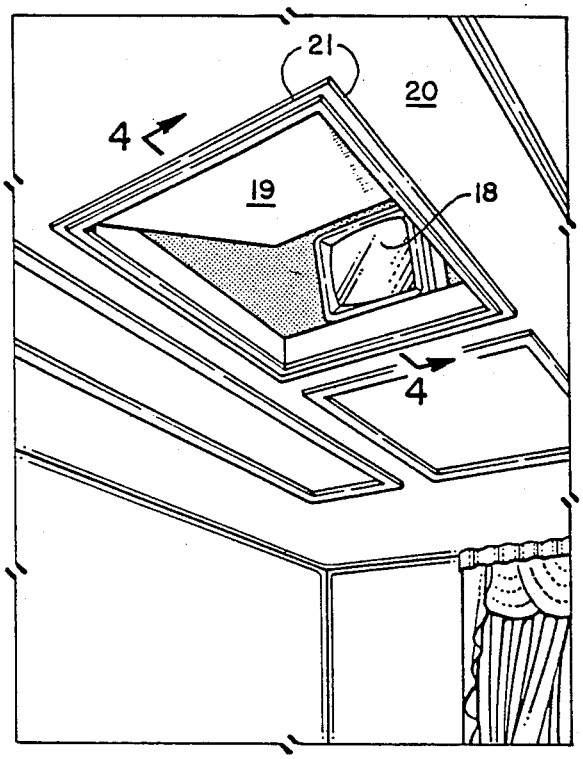
Figure 2:
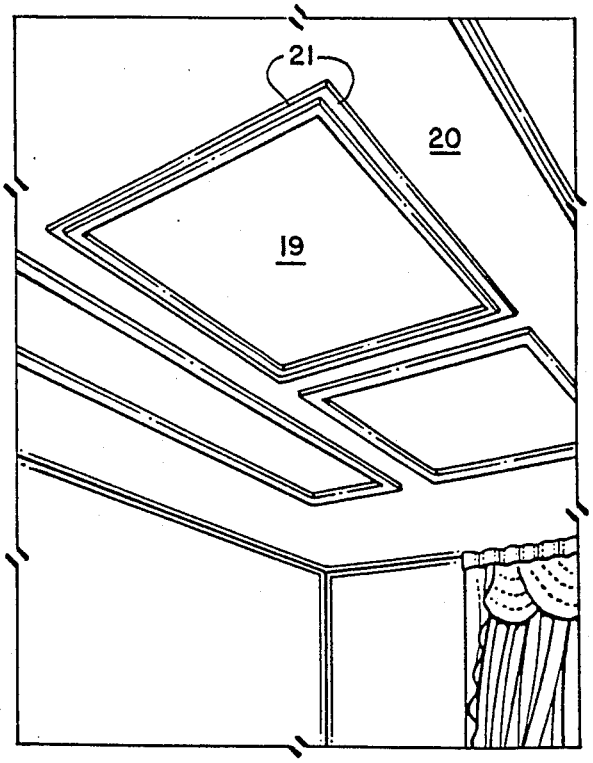
Figure 3:
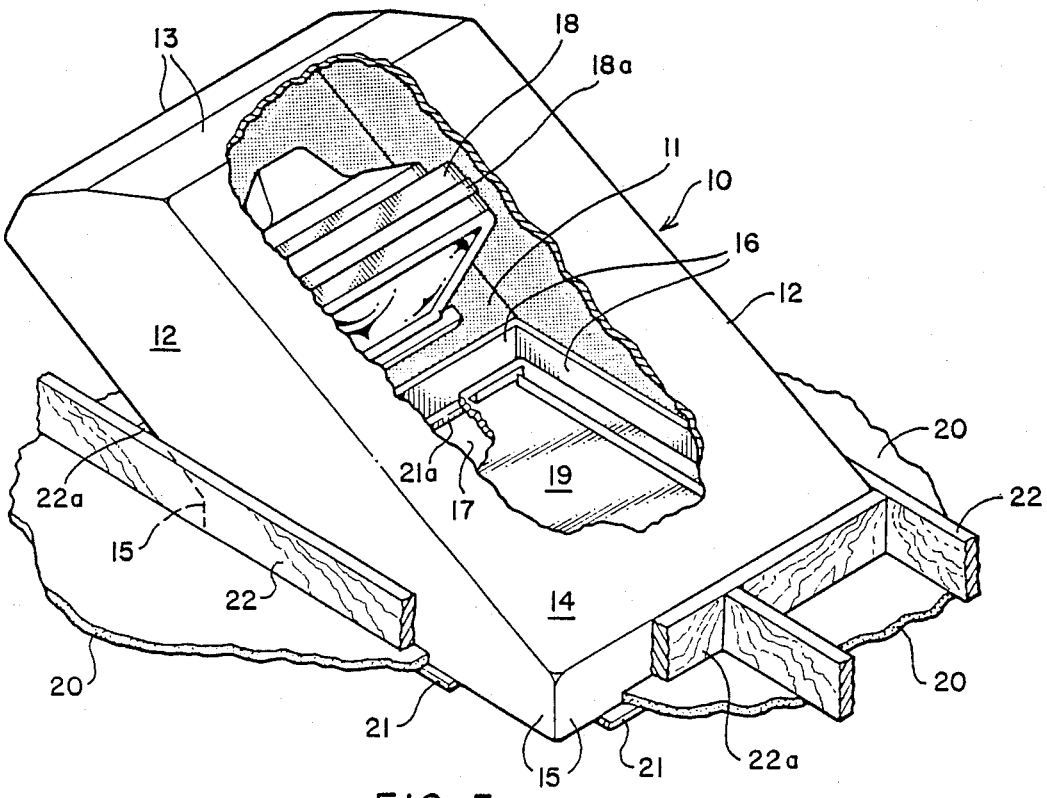
Figure 4:
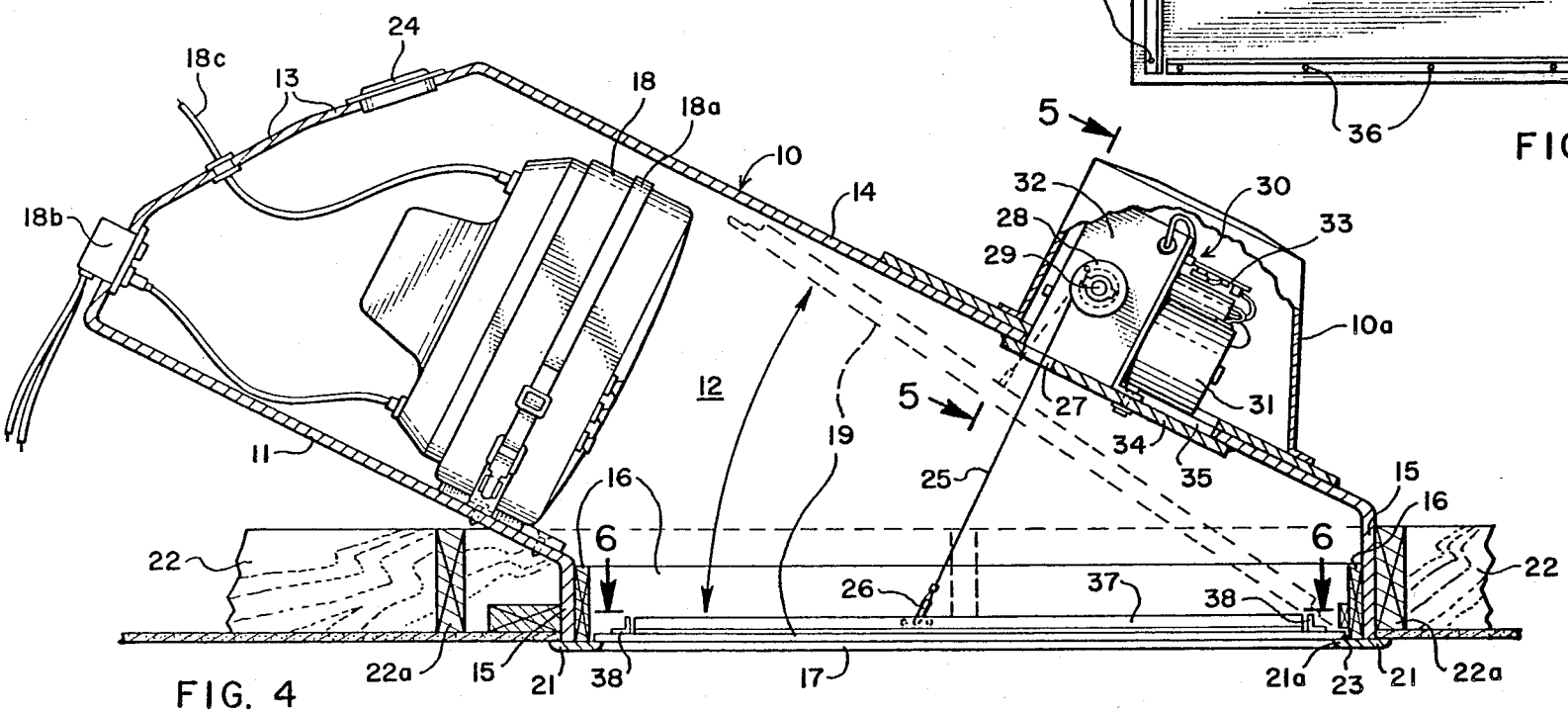

In the form illustrated, a box-type housing 10, FIG. 3, shown as fabricated integrally from preferably resin-impregnated fiberglass, has an upwardly sloping bottom wall 11, mutually opposite side walls 12, respectively, a rear wall 13, and a top wall 14 rising and sloping backwardly from a frame portion 15, FIG. 3, that fits about a structural base frame 16. Such base frame 16 defines a bottom opening 17 through which a usual type of television receiving set 18, resting on and strapped to bottom wall 11 as by a strap **18*a*, is viewed when a ceiling panel 19 is raised from its normal ceiling position closing viewing opening 17, as shown in FIGS. 2–4. In this illustrated instance, the room ceiling 20 is paneled ornamentally, with molding strips 21 defining individual panels and with housing 10 and base frame 16 fitting between and fastened to usual ceiling joists 22 in an opening between two of such joists which is provided by cutting out a portion of an intervening joist and applying headers 22*a*** at opposite ends of the opening.

Ceiling panel 19 is hinged along its forward end, see 23, FIG. 4, considering the television set to be mounted rearwardly in the housing, for opening and closing as a door. As shown, hinging 23 is accomplished by freely resting the forward end of panel door 19 on the recess-invading margin **21*a* of the forward transverse molding strip 21. A heat vent 24 may be provided in rear wall 13 of housing 10**.

By invading recess 17, molding strips 21 provide peripheral seating structure for ceiling panel door 19 marginally and peripherally of such viewing opening 17. Panel door 19, viewing opening 17, and the seating structure are preferably of rectangular configuration, as shown.

For raising and lowering ceiling panel door 19 on its hinge axis 23, a flexible line, usually a cable 25, has one end fastened to the upper face of such panel door, as by an eye 26, and is passed through an opening 27 at the top of housing 10 to connection of its opposite end with remote-controlled lifting and lowering mechanism, which is preferably mounted on top wall 14, exteriorly of such housing.

Figure 5:
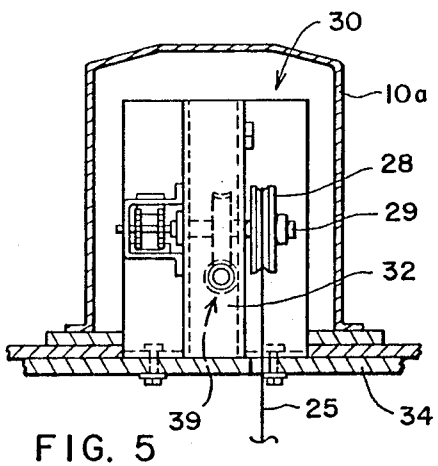

In the embodiment of panel lifting and lowering mechanism shown in FIGS. 4 and 5, such opposite end of cable 25 is attached to a cable wind-up pulley 28 mounted for rotation on the outwardly projecting drive shaft 29 of a drive unit 30 equipped with a reversible electric motor 31, a speed reducer 32, limit switches (not shown), and remote control equipment 33. So as to be easily removable from the interior of housing 10 by way of viewing opening 17 for repair or replacement when panel door 19 is removed by reason of its free hinging to housing 10, drive unit 30 is mounted on a base plate 34 which is removably fastened, as by means of screws (not shown), to the inside face of top wall 14 of housing 10 across an opening 35 in such top wall. Preferably base plate 34 is an elongate piece of plywood that extends from side-to-side of housing 10 and is fastened thereto at intervals along its length so as to adequately support drive unit 30.

A protective cover **10*a* for drive unit 30 is preferably securely fastened in some suitable manner to top wall 14 of housing 10**.

Drive unit 30 can be obtained commercially from manufacturers of standard garage door openers. The limit switches should be arranged for activation on the basis of a predetermined number of drive shaft rotations, which is standard in many commercially available drive units.

As in the construction shown in our aforesaid patent, a plug-in power supply **18*b* for television receiver 18 is normally mounted in back wall 13 of housing 10, and a lead cable 18*c*** for a TV antenna conveniently passes through such back wall.

Figure 6:
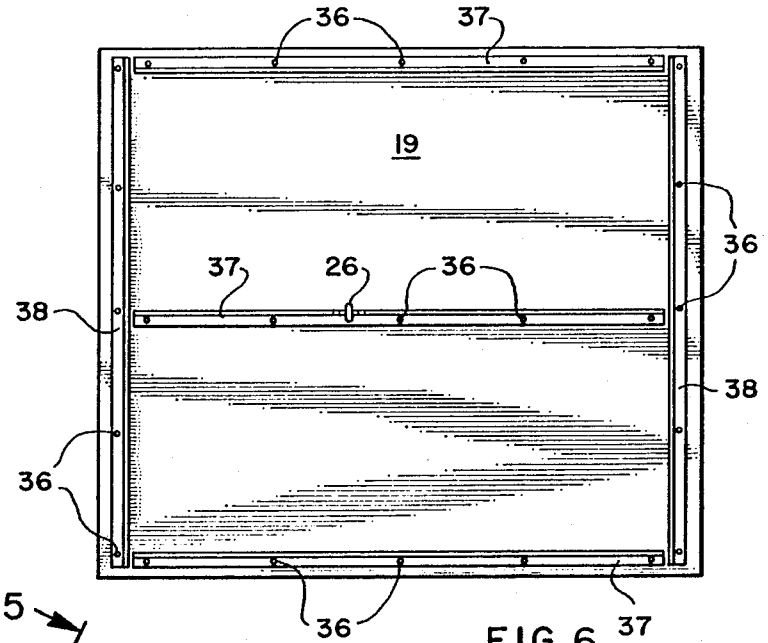

In order to insure uniform seating of ceiling panel door 19 around its entire peripheral margin when in the closed position, as against uncertain and often nonuniform seating of a ceiling door panel made, for example, of three quarter inch plywood, such ceiling panel door 19 is made of a pliable sheet material having sufficient rigidity to retain its shape when being raised and lowered as a door. Preferably, such pliable sheet material is a medium density fibreboard, e.g. the commerical product "Masonite" one-quarter of an inch in thickness, with its upper face firmly reinforced peripherally and, depending upon its shape and size in individual instances, intermediate its width as well. Reinforcement is accomplished in the illustrated instance in which the panel door 19 is of rectangular configuration 34 and ½ by 38 and ½ inches, by securely fastening thereto, as by series of screws 36, FIG. 6, longitudinal and transverse lengths 37 and 38, respectively, of rigid, structural, reinforcing material, preferably one-inch structural steel angles. At least one, here only one, longitudinal length 37 is fastened intermediate the longitudinal margins of panel 19, here midway of the width, the several longitudinal lengths preferably stopping somewhat short, e.g. one-sixteenth of an inch, of actually abutting against, i.e. intersecting, the transverse lengths 38, as illustrated, so the several separate lengths are wholly independent and free of one another.

The lengths 37 and 38 marginally of panel door 19 are inset inwardly of the edges and of the seating margins **21*a* of the panel somewhat, e.g. here one-half inch at the longitudinal margins, three-quarters of an inch at the forward transverse margin, and one inch and an eighth at the rearward margin where hinging 23 is located, the seating margins 21*a*** being three-eighths of an inch in width.

As so constructed, it has been found preferably to bevel the forward edge face of panel door 19 backwardly from the bottom edge of such edge face on a forty-five degree slope, thereby locating the hinge axis at the forwardly placed, transverse, lower edge of such bevel, leaving the entire panel door free of securement to the door framing structure 16. This is an advantage costwise as well as providing for full and easy access to the interior of housing 10 by removal of such panel door if and when required.

It is desirable to use the particular lifting mechanism of FIGS. 4 and 5 whenever there is sufficient headroom above housing 10. Thus, cable 25 has one end secured to intermediate angle length 37 by eye 26 and the other end to pulley 28 for winding and unwinding thereon as such pulley is driven in one direction or the other by electric motor 31. Intersecting spiral gears 39 serve to rotate pulley 28 from output shaft 29 at proper speed whether motor 31 is operating in forward drive or reverse. The limit switches stop rotation at opposite ends of the door lifting and the door lowering strokes. Although a single reversible electric motor is preferred for the mechanism, a similar result could be achieved by more complicated but equivalent mechanisms within the skill of the art.

Although a usual type of television receiving set will normally be mounted in the device of the invention so as to be viewed through the viewing opening when the ceiling panel door is opened, a projection type of television receiving set could be mounted in housing 10 so as to project the picture through the viewing opening onto a screen mounted in the room.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. Behind-the-ceiling mounting for a television receiver, comprising a support for a television receiver, said support being mounted above the ceiling of a room and sloping upwardly from a margin of a viewing opening provided in said ceiling; a ceiling panel door hinged along a margin of a viewing opening that is opposite the first-named margin for being raised from a position closing said opening to an open, television viewing or projecting position and for being lowered from said open position back to the position closing the viewing opening; panel door seating means disposed marginally and peripherally of said viewing opening for receiving said panel door in its closed position; mechanism for raising and lowering said panel door; a flexible line having one end connected to said panel door and the other end connected to said mechanism, said mechanism comprising a remotely controlled, reversible motor, means driven by the motor for alternately pulling and slackening said flexible line so as to raise said panel door to its open position and so as to permit it to fall back to its position closing said viewing opening, respectively, and limit switches controlling supply of power to said motor so as to stop operation of the motor at the termination of the opening and closing movements, respectively; said ceiling panel door being sheet pliable material having sufficient rigidity to substantially retain its shape during raising and lowering of said door; and mutually independent lengths of rigid reinforcing material secured to the upper surface of said panel door inwardly thereof from but adjacent to said seating means marginally and peripherally of said viewing opening.

2. Mounting for a television receiver according to claim 1, wherein the lengths of reinforcing material do not intersect.

3. Mounting for a television receiver according to claim 1, wherein the lengths of reinforcing material include at least one length extending from front to back of the panel door intermediate the width of said panel door.

4. Mounting for a television receiver according to claim 3, wherein the viewing opening, the seating means, and the panel door are of rectangular configuration and the one length extending from front to back of the panel door is midway of the width of said panel door.

5. Mounting for a television receiver according to claim 1, wherein the sheet of pliable material is medium density fibreboard substantially one-quarter of an inch in thickness.

6. Mounting for a television receiver according to claim 5, wherein the lengths of reinforcing material are rigid structural angles.

7. Mounting for a television receiver according to claim 1, wherein the door is freely hinged so as to be removable.

8. Mounting for a television receiver according to claim 7, wherein the support is in the bottom wall of a protective housing having an apertured top wall, the mechanism being mounted on a base plate which is removably secured to the inside face of said top wall below the aperture therein.

9. A behind-the-ceiling television receiver mounting for installation in ceiling structure, comprising a housing having an open base adpated to fit over a corresponding viewing opening in the ceiling of a room, a bottom wall sloping upwardly and backwardly from a margin of said base for receiving and supporting a television receiver, and additional walls sloping backwardly and upwardly from said open base and arranged to enclose a television receiver on said bottom wall; a ceiling panel in said base adapted to be fitted over said viewing opening of the ceiling and hinged to open and close as a door along a margin of said panel that is opposite said margin of the base; mechanism for raising and lowering said panel door; a flexible line having one end connected to said mechanism and the other end attached to said panel door, said mechanism comprising a remotely controlled, reversible motor, means driven by the motor for alternately pulling and slackening said flexible line so as to raise said panel door to its open position and so as to permit it to fall back to a position in said base closing said viewing opening, respectively, and limit switches controlling supply of power to said motor so as to stop operation of the motor at the termination of the opening and closing movements, respectively; said panel door being sheet pliable material having sufficient rigidity to substantially retain its shape during raising and lowering of said door; and mutually independent lengths of rigid reinforcing material secured to the upper surface of said panel door inwardly from but adjacent to peripheral seating margins of said door peripherally of said viewing opening.

10. Mounting for a television receiver according to claim 9, wherein the lengths of reinforcing material do not intersect.

11. Mounting for a television receiver according to claim 9, wherein the lengths of reinforcing material include at least one length extending from front to back of the panel door intermediate the width of said panel door.

12. Mounting for a television receiver according to claim 11, wherein the viewing opening and the panel door are of rectangular configuration and the one length extending from front to back of the panel door is midway of the width of said panel door.

13. Mounting for a television receiver according to claim 9, wherein the sheet of pliable material is medium density fibreboard substantially one-quarter of an inch in thickness.

14. Mounting for a television receiver according to claim 13, wherein the lengths of reinforcing material are rigid structural angels.

15. Mounting for a television receiver according to claim 9, wherein the door is freely hinged so as to be removable.

16. Mounting for a television receiver according to claim 15, wherein the housing has an apertured top wall, the mechanism being mounted on a base plate which is removably secured to the inside face of said top wall below the aperture therein.

* * * * *